United States Patent [19]

Tilve

[11] 3,977,516

[45] Aug. 31, 1976

[54] EYEGLASS RECEPTACLE

[76] Inventor: Enrique Jesús Ramón Tilve, Jose Marti 1467, Buenos Aires, Argentina

[22] Filed: July 1, 1974

[21] Appl. No.: 484,999

[30] Foreign Application Priority Data

June 29, 1973 Argentina ..... 248857

[52] U.S. Cl. ..... 206/5; 224/26 D

[51] Int. Cl.[2] ..... A45C 11/04

[58] Field of Search ..... D57/1 B; 150/52 R, 52 J; 206/5, 6, 260; 224/5 R, 26 R, 26 D; 220/339; 229/41 B

[56] References Cited

UNITED STATES PATENTS

| | | | |
|---|---|---|---|
| 967,487 | 8/1910 | Baker | 224/26 D |
| 1,088,885 | 3/1914 | Dorris | 150/52 J |
| 1,648,565 | 11/1927 | Primley | 224/26 D |
| 2,308,003 | 1/1943 | Gamrod | 150/52 J |
| 2,688,395 | 9/1954 | Gay, Jr. et al. | 206/5 |
| 2,723,745 | 11/1955 | McNeill | 206/5 |
| 3,136,549 | 6/1964 | Ruderian | 224/5 R X |
| 3,148,812 | 9/1964 | Hilsinger, Jr. | 224/5 R |
| 3,587,699 | 6/1971 | Kovach | 150/52 R |
| 3,638,788 | 2/1972 | Solomon | 220/339 X |
| D30,934 | 6/1899 | Guyer | D57/1 B |

FOREIGN PATENTS OR APPLICATIONS

| | | | |
|---|---|---|---|
| 1,208,161 | 9/1959 | France | 206/5 |
| 76,396 | 8/1961 | France | 206/5 |
| 3,240 | 10/1913 | United Kingdom | 206/5 |

*Primary Examiner*—Steven E. Lipman

[57] ABSTRACT

Folding eyeglass receptacle for pocket, briefcase and similar use, comprising a unitary member preferably made from a flexible yet durable material, including bottom, forward and rear portions joined by fold lines, the forward and rear portions having wing portions, possibly with similar fold lines, a lid and a lapel portion being successively attached to the rear portion, and nipples and corresponding openings for securing together the forward and the rear portions, and for connecting together the forward and the lid portions. The fold lines are preferably constituted by weakened zones of lesser thickness between respective adjoining pairs of the portions which form the unitary member.

6 Claims, 5 Drawing Figures

FIG.1
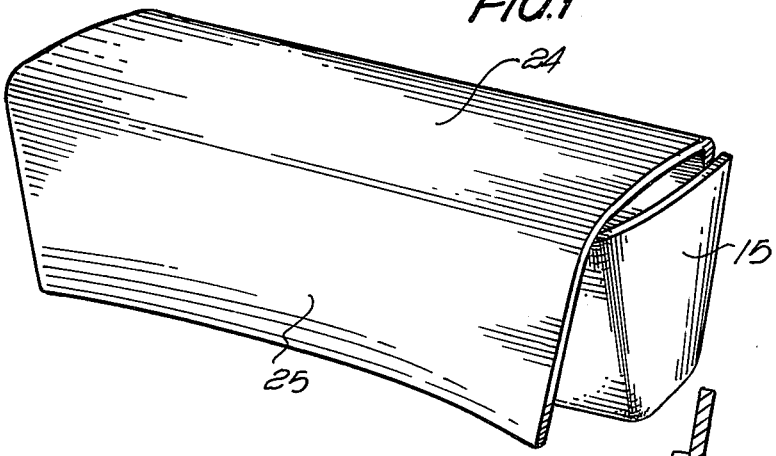
FIG.3
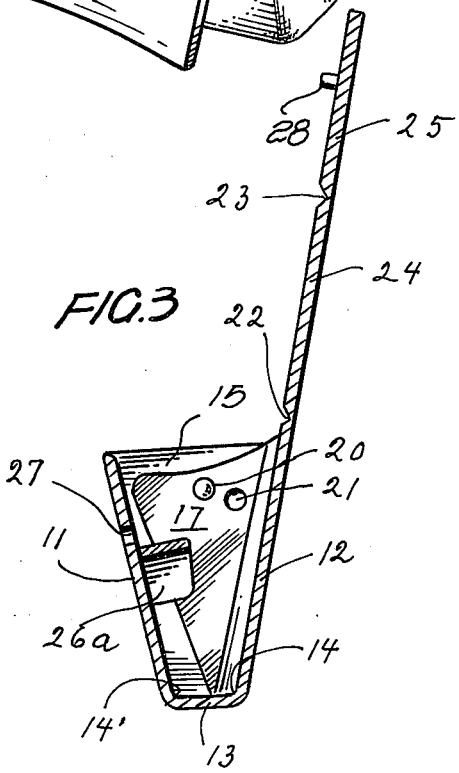
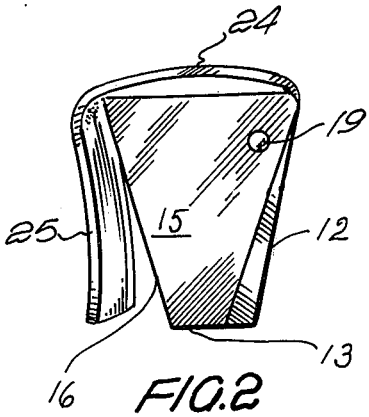
FIG.2

FIG.5
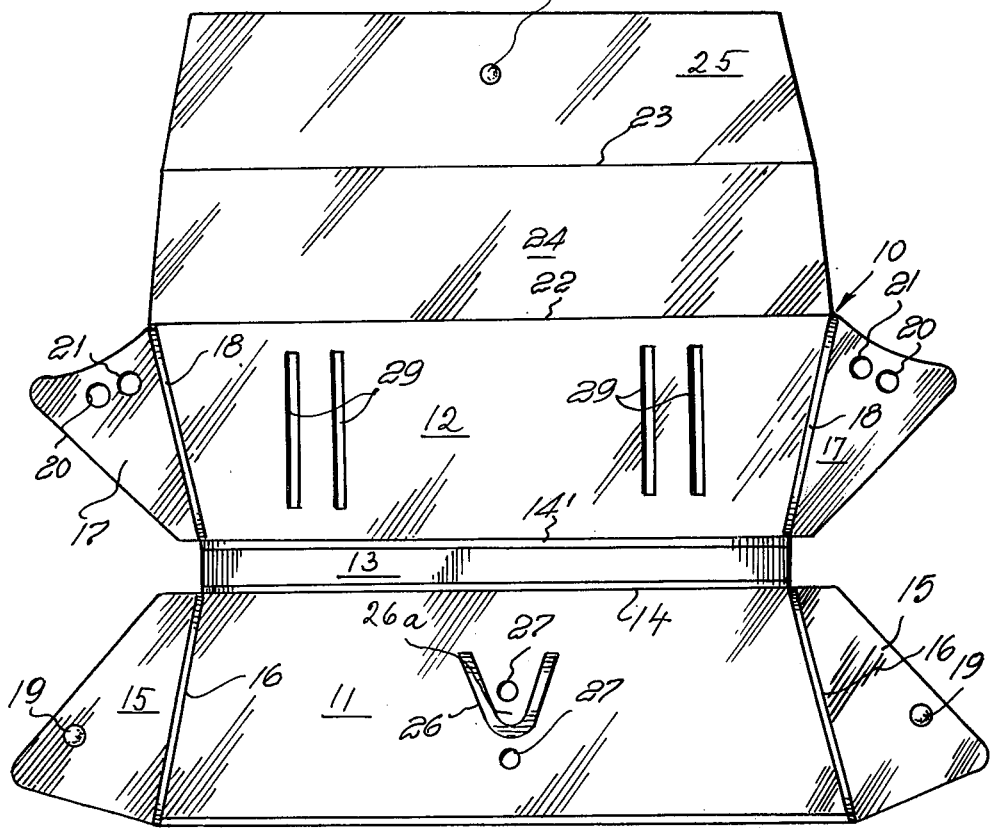
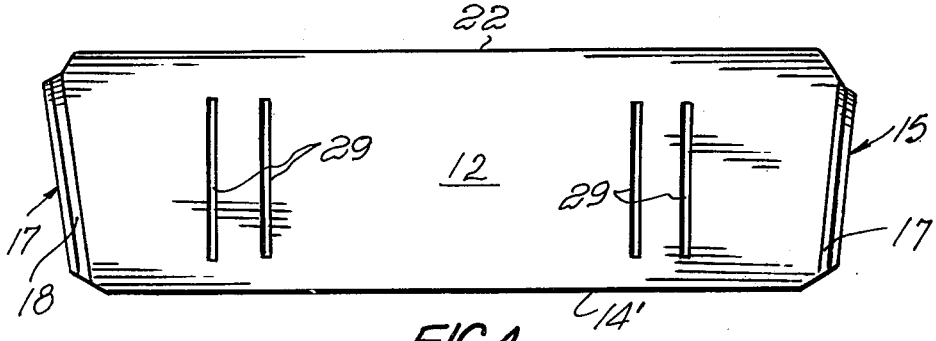
FIG.4

EYEGLASS RECEPTACLE

The present invention relates to an improved receptacle for eyeglasses and the like, such as for pocket, briefcase and similar use.

Many eyeglass receptacles and holders are known but they all have the disadvantage that by their structural characteristics they are expensive yet do not permit easy adaptation for the holding or storing of glasses of various sizes, including large-size modern eyeglasses, sunglasses, etc., especially when one considers the vagaries of modern fashions.

By means of the present invention a folding receptacle is provided for eyeglasses which through its construction makes it more economical to manufacture, and also makes it easier to adapt the same to different sizes and shapes of glasses, and also in the management thereof.

The present invention relates to a folding receptacle for eyeglasses, characterized in that it is constituted by a single, unitary member or base including a forward and a rear portion joined together by a bottom portion along fold lines, the forward and rear portions being provided with lateral wings having also means for securing them together, the upper edge of the rear portion extending along another line of fold, then including a lid which terminates in a lapel capable of being superposed over the forward portion, the lid and forward portion being provided with means for connecting them together.

According to further important features of the invention, the connecting means may be constituted by nipples and corresponding openings.

The fold lines between adjoining pairs of the portions that constitute the unitary member are preferably constituted by weakened zones of lesser thickness.

The rear portion may be provided with at least one pair of recesses or cuts for passing therethrough a belt and the like for purposes of carrying or supporting the receptacle.

The forward portion may have on its inner surface a pinch, formed for example by a curved cut-out, defining an area that constitutes a bumper against flattening of the receptacle, e.g. when carried in a pocket, to which end the bumper is extended perpendicular to the plane of the forward portion.

In order that the present invention may be better understood it will now be described with reference to a preferred, exemplary embodiment by way of the illustration in the accompanying drawings, wherein FIG. 1 is a perspective view of the inventive eyeglass receptacle, shown in its closed condition;

FIG. 2 is a view in side elevation of the receptacle of FIG. 1;

FIG. 3 is a front-to-rear cross section of the receptacle in its open condition, corresponding to the elevational view of FIG. 2;

FIG. 4 is a view of the rear portion of the receptacle, with lateral wings closed; and FIG. 5 is a spread-out or plan view of the inventive case or receptacle.

The receptacle for eyeglasses and the like consists essentially of a unitary member or base generally designated by numeral 10, having a forward portion 11 and a rear portion 12 joined together by a bottom portion (best seen in FIG. 5). The latter portion is joined to the edges of the forward and rear portions 11, 12 by lines of fold 14, 14', respectively, preferably constituting weakened zones of lesser thickness than the base member 10.

It will be understood that all or portions of the receptacle can be made from a flexible yet durable material, such as leather, certain plastics, even textiles, and the like.

The forward portion 11 has two lateral wings 15 joined by lines of fold 16, while the rear portion 12 has similar wings 17 joined by lines 18. In FIG. 5 the wing portions are open while in FIGS. 1 through 4 they are closed. When in the folded-in positions, it is usually the wing 15 which is outside while wing 17 is inside.

The wings 15, 17 are provided with meas for securing them together, and which are illustrated by nipples 19 of the wings 15 selectively engageable in openings 20, 21 of the wings 17, depending on the thickness of the eyeglasses to be accommodated in the inventive device.

The remote edge of the rear portion 12 is extended along a line of fold 22 to a lid portion 24 which in turn ends in a lapel 25 through another fold line 23.

The forward portion 11 may have in its inner surface a stop or bumper area **26*a*, within one or more, preferable curved cut-outs 26, as shown. This is to protect against the flattening of the receptacle, e.g. when worn in a pocket. At least two openings 27 (only one being visible in FIG. 3) are also provided, for a nipple and the like 28 (omitted from FIG. 2 for the sake of clarity) which is in the inner surface of the lapel portion 25. The rear portion 12 has recesses 29** for receiving a belt and the like when the receptacle should be worn in a suspended manner.

When the base member 10 is made in the form shown in FIG. 5, the forward and rear portions 11, 12 are folded along the lines 14, 14', causing the wings 15, 17 to be superposed upon each other and being joined subsequently through the nipples 19 within one of the openings 20, 21, according to whether one wishes to increase or decrease the capacity of the receptacle, the latter remaining in the form shown in FIG. 3 and ready to receive eyeglasses.

For closing the receptacle the lid 24 is folded at the line 22 and then the lapel 25 is folded along its line 23, and thus the latter superposes itself upon the forward portion 11 in such manner that the nipple 28 may engage in either of the openings 27, whereby the receptacle is in the closed condition illustrated in FIGS. 1, 2. It will be understood that the bumper area **26*a* is usable regardless of whether the upper or the lower opening 27** is engaged.

It will be understood by those skilled in the art that the present invention is not limited in any way to the exemplary embodiment described and illustrated herein, and that various modifications may be made without departing from the spirit and scope of the invention.

What I claim is:

1. A folding eyeglass receptacle comprising, in combination, a unitary member including a narrow bottom portion, a forward portion and a rear portion, joined together by respective fold lines, said forward and said rear portions being provided with respective lateral, generally triangular wing portions having nipples and corresponding openings selectively provided therein and securing them together, the edge of said rear portion remote from said bottom portion extending along another fold line, and a lid portion attached to said rear portion, which lid portion terminates in a foldable lapel portion superposed in the closed condition of the receptacle over said forward portion, the latter and said lid portion being provided with further nipples and corresponding openings therein for connecting them together, and wherein said bottom portion is substantially shorter than the combined lengths of said forward and said rear portions with the respective ones of said wing portions thereon, the receptacle in the folded and closed condition displaying a side view of an inverted truncated cone, the apparent edges of which are formed successively by said bottom, said forward, said lid and finally said rear portions.

2. The eyeglass receptacle as defined in claim 1, further comprising fold lines along which said wing portions are joined to said forward and said rear portions, and wherein at least some of said fold lines are constituted by weakened zones of lesser thickness between respective adjoining pairs of said portions.

3. The eyeglass receptacle as defined in claim 1, wherein at least said lid and said lapel portions and said wing portions are made from a flexible yet durable material.

4. The eyeglass receptacle as defined in claim 1, wherein said rear portion has therein at least one pair of recesses for passing a belt and the like therethrough for purposes of carrying the receptacle.

5. The eyeglass receptacle as defined in claim 1, wherein said forward portion has on its inner surface at least one cut-out defining a bumper portion against flattening the receptacle in the closed condition, said bumper portion being extended substantially perpendicular to the plane of said forward portion.

6. The eyeglass receptacle as defined claim 5, wherein said bumper portion is limited by a single curved cut-out.

* * * * *